US006739919B2

(12) United States Patent
Murakami et al.

(10) Patent No.: US 6,739,919 B2
(45) Date of Patent: May 25, 2004

(54) WIRING BASE AND ELECTRICAL CONNECTION BOX

(75) Inventors: Masakazu Murakami, Tokyo (JP); Tatsuo Satori, Tokyo (JP); Kazuo Miyajima, Tokyo (JP)

(73) Assignee: The Furukawa Electric Co., Ltd., Tokyo (JP)

( * ) Notice: Subject to any disclaimer, the term of this patent is extended or adjusted under 35 U.S.C. 154(b) by 0 days.

(21) Appl. No.: 10/295,646

(22) Filed: Nov. 15, 2002

(65) Prior Publication Data

US 2003/0124912 A1 Jul. 3, 2003

(30) Foreign Application Priority Data

Dec. 27, 2001 (JP) ..... 2001-397805
Dec. 27, 2001 (JP) ..... 2001-397806

(51) Int. Cl.[7] ..... H01R 9/22
(52) U.S. Cl. ..... 439/719; 439/717; 439/594
(58) Field of Search ..... 439/719, 403, 439/404, 942, 594, 717

(56) References Cited

U.S. PATENT DOCUMENTS 3,777,223 A * 12/1973 Chandler et al. ..... 361/823
4,066,317 A * 1/1978 Bierenfeld et al. ..... 439/355
4,101,189 A * 7/1978 Moser et al. ..... 439/405
4,669,799 A * 6/1987 Vachhani et al. ..... 439/404
5,554,053 A * 9/1996 Matthews ..... 439/719

FOREIGN PATENT DOCUMENTS

JP 2001-286038 10/2001

* cited by examiner

*Primary Examiner*—Tho D. Ta
(74) *Attorney, Agent, or Firm*—Cohen, Pontani, Lieberman & Pavane

(57) ABSTRACT

An electrical connection box is comprised of a wiring base group constituted by a minimum number of wiring bases required to realize a wiring pattern suitable to specifications of the connection box. Each wring base includes a base body, wing portions provided on an outer periphery of the base body having end faces each formed with a coupling portion to which another wiring base of the same construction can be coupled, and guide portions integral with the wing portions and projecting circumferentially therefrom. In receiving a wire fed from a wiring head in a desired wire groove of the wing portions via a corresponding wire guide groove of the guide portions, the guide portion concerned prevents the wire from being dislocated from the wire groove, resulting in increased wiring speed, shortened wiring time and reduced manufacturing costs.

10 Claims, 8 Drawing Sheets

WIRING BASE AND ELECTRICAL CONNECTION BOX

BACKGROUND OF THE INVENTION

1. Technical Field

The present invention relates to a wiring base and an electrical connection box using the same.

2. Related Art

A wired assembly for an electrical connection box is known that includes a wiring base and a wire arranged thereon. Japanese provisional patent publication no. 2001-286038 discloses a method for manufacturing a wired assembly in which, as shown in FIG. 15A, a wire 7 to be arranged on a wiring base B is fed from a wiring head 6, with a wiring base B rotated around its rotation axis together with a holder (not shown) supporting the same and with a wiring head 6 moved along the rotation axis of the wiring base. As a result, the wire 7 is wound on the wiring base B, with the desired wire portions received in corresponding ones of wire grooves formed in the wiring base. Although a detailed illustration is omitted, the wire 7 is thereafter cut off at its desired portions, and connecting terminals are forcibly inserted into corresponding ones of terminal grooves that are formed in the wiring base so as to communicate with the desired wire grooves, whereby the connecting terminals are electrically connected to a conductor of the wire, thus completing the fabrication of a wired assembly. By connecting electrical components to the connecting terminals through connectors, an intended electrical circuit is attained.

A wiring pattern (i.e., the wire-cutting positions and terminal-insertion positions) in the wired assembly varies depending on specifications of the electric circuit to which the wired assembly is applied. To some extent, a conventional wired assembly can comply with the varying wiring pattern by changing wiring and terminal insertion programs, in accordance with which a wiring apparatus is operated. However, when the required number of wire grooves or terminal grooves to realize the desired wiring pattern exceeds the number of grooves actually formed in the wiring base, there occurs a problem of an additional wiring base being required to eliminate shortage of grooves. Contrary to this, when the required number of grooves is considerably less than the grooves formed in the wiring base, most of the wire grooves or terminal grooves formed in the wiring base are not used to realize the desired wiring pattern. Thus, there occurs another problem of the wiring base to realize the desired wiring pattern being excessively large in size, resulting in an oversized electrical connection box.

As for a connecting terminal that is generally formed into a crank shape, it can buckle while being mounted with a connector after the connecting terminal is inserted into a terminal groove of the wiring base.

Moreover, during the operation of laying a wire 7 on the wiring base B while rotating the wiring base around its longitudinal axis together with a holder (not shown) supporting the same, a wiring head 6 is caused to rotate when it interferes with the wiring base, to thereby permit further rotation of the wiring base so that the wiring operation can be continued (see FIGS. 15A and 15B). With the conventional arrangement shown in FIGS. 15A and 15B, however, the wire 7 fed from the wiring head 6 starts being accommodated in a wire groove Ba of the wiring base B only after the wiring base rotates for a considerable angle from when it is in line- or point-contact with the wiring head 6. In this manner, the wiring head 6 rotates for a large angle relative to the wiring base B from when it becomes in contact with the wiring base to when it starts being accommodated in the wire groove Ba, and hence the distance between a wire feed port of the wiring head and the wire groove increases. Further, the wiring head is initially in line- or point-contact with the wiring base, and is hence liable to be deviated in the longitudinal direction of the wiring base due to a lateral force acting thereon in the longitudinal direction. Thus, the wire 7 tends to be dislocated from the wire groove Ba in which it is to be received. Such a phenomenon becomes noticeable at higher wiring speeds, and as a result the wire fed from the wiring head can be dislocated from the wire groove, making it difficult to carry out an accurate wiring operation.

To obviate this, the wiring speed is heretofore lowered to suppress the positional deviation of the wiring head. However, a low wiring speed requires a prolonged period of time for fabrication of the wired assembly. In order to complete the fabrication of a desired number of wiring assemblies within a prescribed period of time, an increased number of wiring apparatuses are required to operate simultaneously. This entails a problem of increased fabrication costs of wired assemblies and electrical connection boxes using the same.

SUMMARY OF THE INVENTION

An object of the present invention is to provide a wiring base that is capable of easily complying with the change in a wiring pattern in accordance with which a wire is to be laid on the wiring base.

Another object of the present invention is to provide a wiring base that is capable of preventing a connecting terminal from buckling when a connector or the like is mounted thereto.

A further object of the present invention is to provide a wiring base that permits a wire to be properly laid on the wiring base even at a higher wiring speed, thus shortening a period of time required for the wiring to thereby reduce fabrication costs.

Still another object of the present invention is to provide an electrical connection box using the aforementioned wiring base.

According to a first aspect of the present invention, there is provided a wiring base molded from an electrical insulating material. The wiring base comprises: a base body extending along a longitudinal axis of the wiring base; wing portions formed on an outer periphery of the base body so as to be circumferentially spaced apart from one another; and coupling portions individually formed in opposite end faces of the base body, each wing portion being formed with wire grooves that individually open to an outer face of the wing portion.

As mentioned above, the wiring base according to the first aspect of this invention, having a coupling portion at each end face thereof, is capable of being coupled with one or two other wiring bases of the same construction as the first-mentioned wiring base. In other words, a wiring base group can be easily constituted by one or more wiring bases. Such a wiring base group makes it easy to comply with the change in the desired number of wire grooves or terminal grooves required to realize an intended wiring pattern, thus contributing to realization of an intended electric circuit.

A wiring base according to a second aspect of this invention comprises: a base body; wing portions formed on an outer periphery of the base body; and a reinforcing plate mounted to a mounting groove that is defined between adjacent ones of the wing portions and that extends along the longitudinal axis of the wiring base. The wing portions are formed with wire grooves and terminal grooves that are in communication with desired ones of the wire grooves. Each terminal groove extends across a corresponding wire groove in the direction of the longitudinal axis of the wiring base, and is arranged to be inserted with a connecting terminal. The reinforcing plate supports connecting terminals individually inserted into corresponding terminal grooves.

With the wiring base according to the second aspect of this invention, connecting terminals inserted into terminal grooves of the wiring base are supported by the reinforcing plate when connectors or the like are mounted to the connecting terminals, thereby preventing the connecting terminals from buckling.

A wiring base according to a third aspect of this invention comprises: a base body; wing portions formed on an outer periphery of the base body; and guide portions respectively formed integrally with the wing portions so as to project circumferentially from the wing portions. Each guide portion is formed with wire guide grooves that open to an outer face of the guide portion and are in communication with the wire grooves, respectively. Each guide portion has a flat outer face thereof extending at an acute angle relative to a boundary face between the guide portion and a corresponding wing portion.

In an operation of laying a wire on the wiring base, a wiring head may be employed that is arranged to returnably rotate with respect to a head support and disposed to interfere with the wiring base.

With the wiring base according to the third aspect of this invention that includes guide portions each having a flat outer face thereof extending obliquely with respect to a corresponding wing portion and having wire guide grooves individually communicating with wire grooves, an angle of rotation of a wiring head from when the outer face of a guide portion interferes with the wiring head to when the wire starts being accommodated in a desired wire groove through a wire guide groove is suppressed to be small, suppressing the increase in the distance between a wire feed port of the wiring head and the desired wire groove. Also, a positional deviation of the wiring head due to a lateral force applied to the wiring head is suppressed. The flat outer face of the guide portion immediately establishes a face-contact with the wiring head, contributing to a suppressed positional deviation of the wiring head. As a result, even at a higher wiring speed, the deviation of the wiring head in the longitudinal direction of the wiring base is suppressed, and the wire fed from the wiring head is prevented from being dislocated from a wire groove in which the wire is to be received, making it possible to carry out the wiring of the wire on the wiring base with accuracy in a short time, whereby a wired assembly comprised of a wiring base and a wire wound therearound can be manufactured at low costs.

An electrical connection box according to a fourth aspect of this invention comprises: a wired assembly, having a wire base group which is comprised of one or more wiring bases according to the first, second, or third aspect of this invention and on which a wire is laid; and a casing accommodating therein the wired assembly.

According to the fourth aspect of this invention, by using one or more wiring bases according to the first aspect of this invention, a wiring base group for realizing an intended wiring pattern suitable to specifications of an electric circuit for the connection box can be constituted by a minimum number of wiring bases, making it possible to obtain an electrical connection box that is compact in size. By using a wiring base according to the second or third aspect of this invention, an electrical connection box can be effectively manufactured at low costs, while preventing connection terminals from buckling or while permitting respective portions of a wire to be accurately accommodated in the desired wire grooves of the wiring base.

DETAILED DESCRIPTION

An electrical connection box according to an embodiment of the present invention will be explained.

Figure 1:
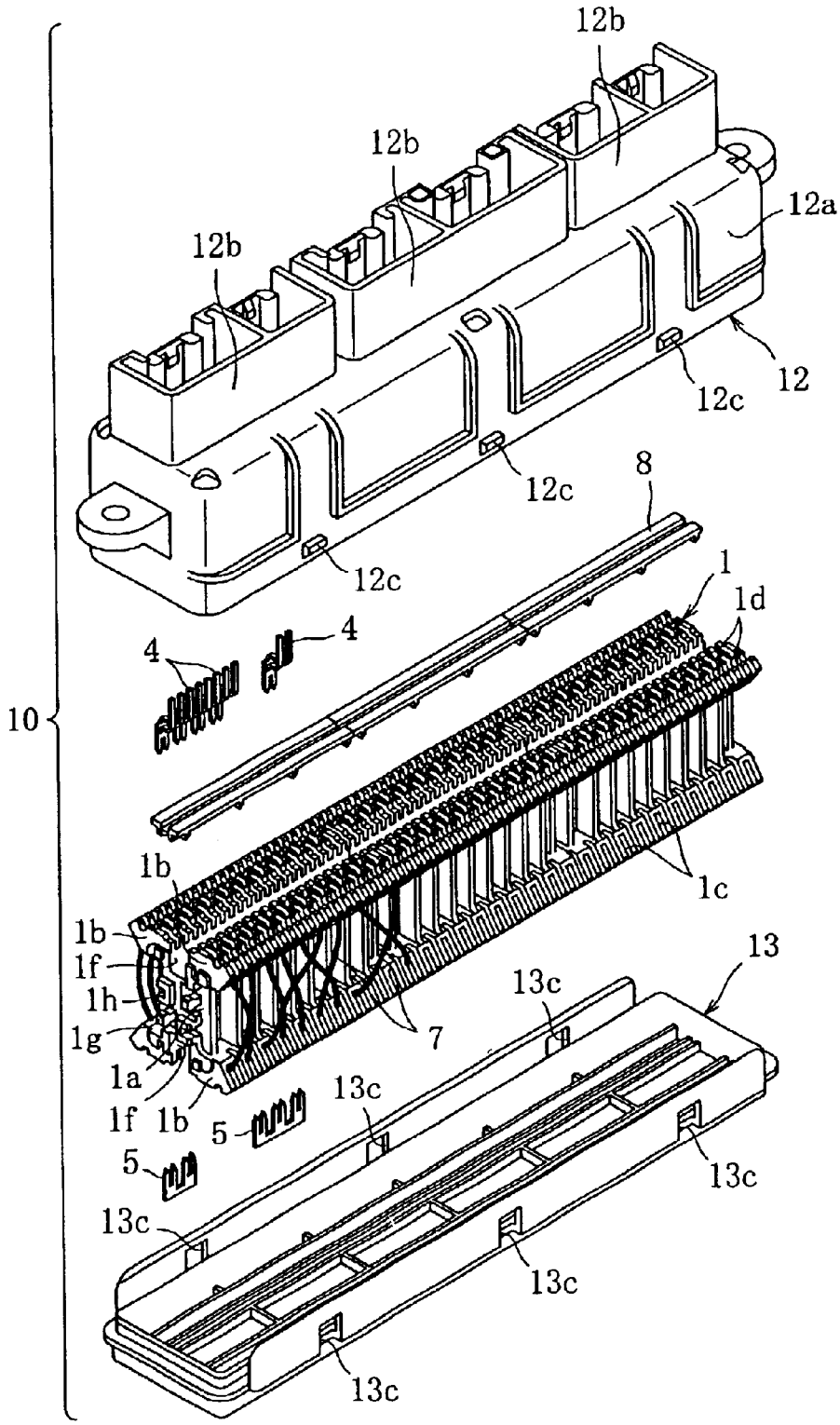
FIG. 1 is an exploded perspective view of an electrical connection box according to an embodiment of this invention.
Figure 2:
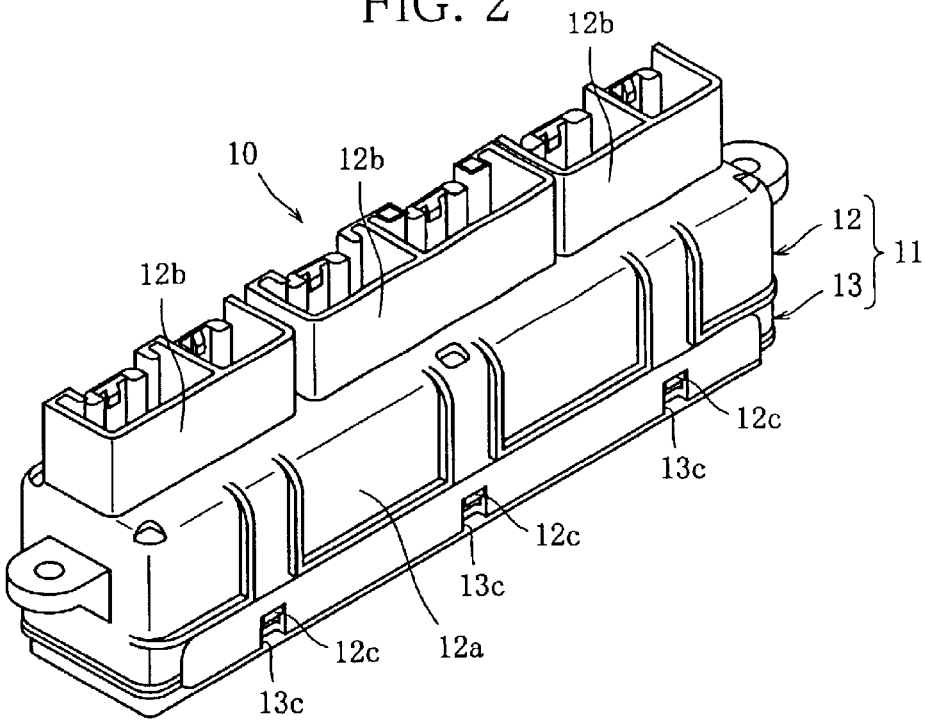
FIG. 2 is a perspective view of the electrical connection box shown in FIG. 1.

As shown in FIGS. 1 and 2, the electrical connection box of this embodiment is comprised of a wired assembly having one or more wiring bases 1 of the same construction and a wire 7 laid thereon, and a casing 11 having upper and lower casings 12, 13 for accommodating therein the wired assembly.

Figure 3:
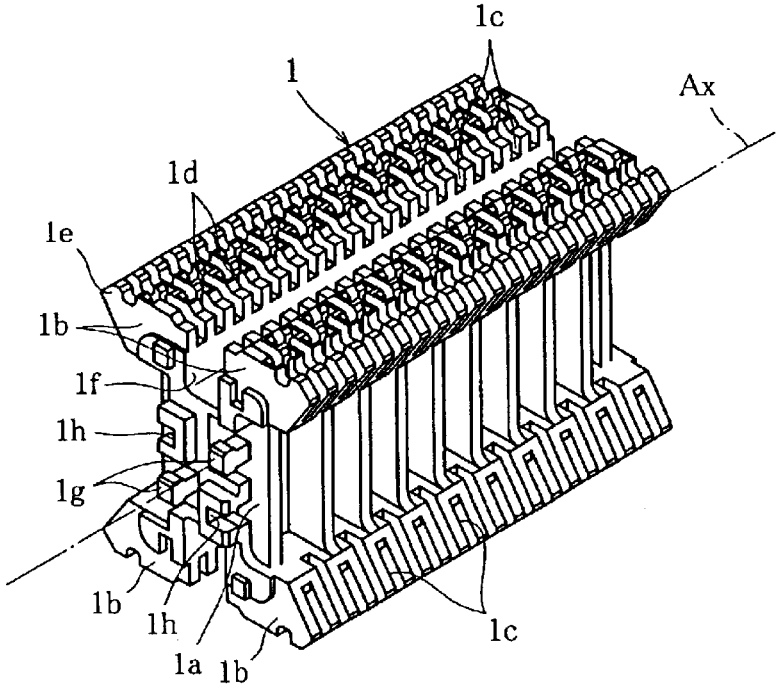
FIG. 3 is a perspective view showing a wiring base of the electrical connection box.
Figure 4:
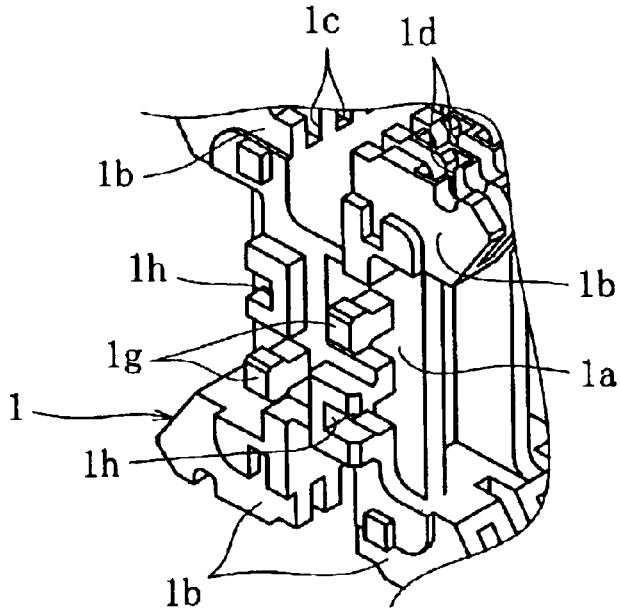
FIG. 4 is a fragmentary enlarged view showing a connecting portion of the wiring base.

As shown in FIGS. 3 and 4, the wiring base 1 is comprised of a base body 1*a* constituted by an electrical insulating synthetic resin such as polypropylene (PP), polybutylene, nylon or the like, and four wing portions 1*b* molded integrally therewith into one-piece from the same resin as that for the base body 1*a*. The four wing portions 1*b* are at the same distance from the longitudinal axis Ax of the base body 1*a* as viewed in traverse cross section, and extend along the axis Ax over substantially the entire length of the base body 1*a*.

Figure 6:
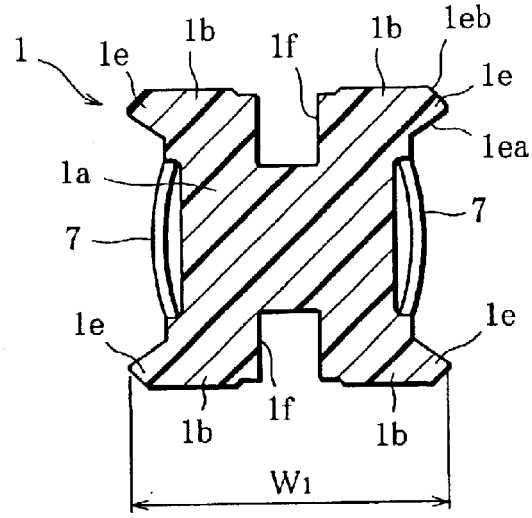
FIG. 6 is an enlarged traverse sectional view of the wiring base.

As best shown in FIG. 6, a cutter groove 1*f* in which a wire-cutting cutter (not shown) is disposed is defined by an exposed upper face of the base body 1*a* and the two wing portions 1*b* that are provided in pair on opposite sides of an upper portion of the base body 1*a*. A similar cutter groove 1*f* is defined by an exposed lower face of the base body 1*a* and the two wing portions 1*b* provided in pair on opposite sides of a lower portion of the base body 1*a*. Both the cutter grooves 1*f* extend along the longitudinal axis Ax over substantially the entire length of the wiring base 1.

As shown in FIG. 3, each wing portion 1*b* is formed at its outer part with a number of wire grooves 1*c* for individually receiving corresponding portions of a wire 7 (FIG. 1) that is wound around the wiring base 1. These wire grooves 1*c* are spaced at equal intervals along the longitudinal axis Ax, and extend in the width direction of the wiring base 1 that is perpendicular to the longitudinal axis Ax. Each of the wire grooves 1*c* formed in each wing portion 1*b* is aligned with corresponding three wire grooves 1*c* individually formed in other three wing portions 1*b*, as viewed in the direction of the longitudinal axis Ax. These aligned four wire grooves 1*c* are at the same distance from the longitudinal axis Ax of the wiring base 1, as viewed in traverse cross section.

The outer part of each wing portion 1*b*, in which a number of wire grooves 1*c* are formed at equal intervals as mentioned above, constitutes a number of guide ribs 1*e* (FIGS. 3, 6 and 7) for guiding a wire 7. In other words, each wing portion 1*b* is formed with a number of guide ribs 1*e*, and each adjacent two guide ribs 1*e* define therebetween a wire guide groove 1*ec* that communicates with a corresponding one wire groove 1*c*.

Each guide rib 1*e* thins towards radially outward (FIG. 7) so as to smoothly guide the wire 7 into a wire groove 1 through a wire guide groove 1*ec*. Preferably, the guide rib 1*e* thins at a boundary with a corresponding wing portion 1*b*, whereby the guide rib 1*e* can be bent to be removed away from the wiring base 1 after the wire is laid on the wiring base (see FIG. 8).

Figure 13A:
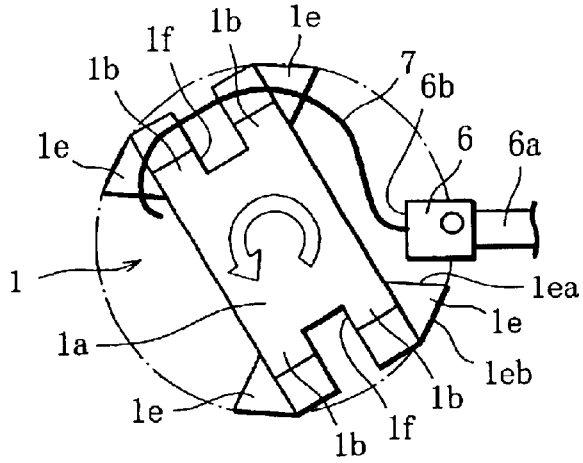
FIG. 13A is a schematic view showing an operation of laying a wire on the wiring base in a state where the guide rib does not interfere with a wiring head.
Figure 13B:
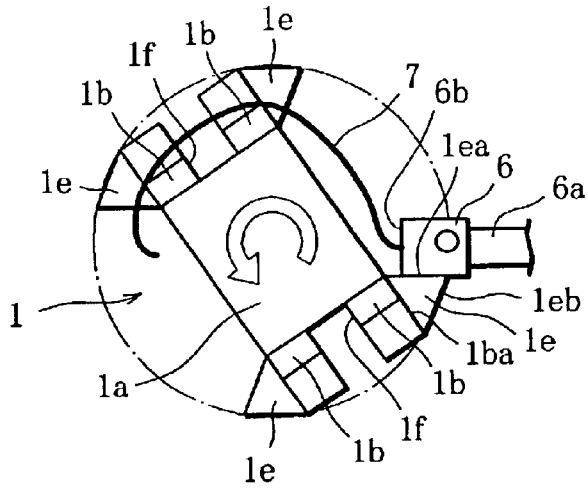
FIG. 13B is a schematic view showing the wire-laying operation in a state where the guide rib interferes with the wiring head.

As shown in FIGS. 6, 13A and 13B, each guide rib 1*e* has a first face 1*ea* which is flat and against which the wiring head 6 used for laying the wire 7 on the wiring base 1 can be abutted. Reference numeral 1*eb* denotes a second face of the guide rib 1*e*.

As understood from FIGS. 6, 8, 13A and 13B, the first face 1*ea* of the guide rib 1*e* extends at an acute angle with respect to a boundary face 1*ba* between the guide rib 1*e* and the wing portion 1*b*. For the reason mentioned later, the acute angle formed between the guide rib 1*ea* and the boundary face 1*ba* preferably corresponds to an angle (FIG. 13B) formed between the wiring head 6 and the boundary face 1*ba* when the guide rib face 1*ea* interferes with the wiring head 6 during the wire 7 being laid on the wiring base 1, whereby the guide rib face 1*ea* is immediately brought in face-contact with the wiring rib 6. Preferably, those four guide ribs 1*e*, which are individually provided on the four wing portions 1*b* of the wiring base 1 and which are at the same position in the direction of the longitudinal axis Ax, are at the same distance from the longitudinal axis Ax as viewed in traverse cross section.

Figure 5:
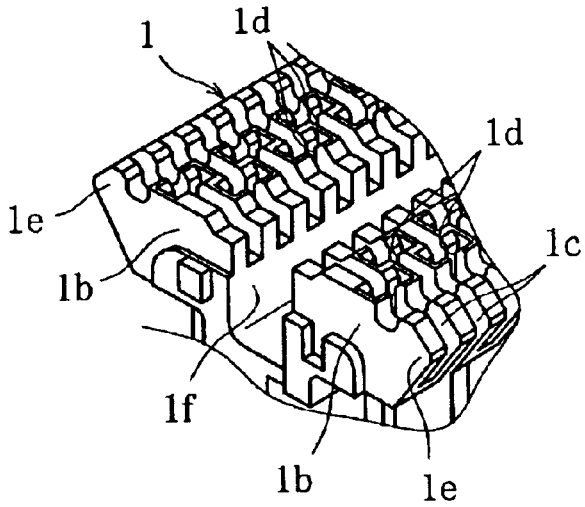
FIG. 5 is a fragmentary enlarged perspective view showing a peripheral part of the wiring base.

Referring to FIGS. 3–5, each wing portion 1*b* is provided with a number of terminal grooves 1*d* for receiving connecting terminals to each of which a connector (not shown) is mounted. Each terminal groove 1*d* is in communication with a corresponding wire groove 1*c* and extends along the longitudinal axis Ax traversely of the corresponding wire groove 1*c*.

In the electrical connection box of this embodiment, if necessary, two or more wiring bases 1, e.g., three wiring bases 1, are coupled for use. To this end, as shown in FIGS. 3 and 4, the base body 1*a* of each wiring base 1 is provided at each end face with two coupling projections 1*g* and two coupling recesses that serve as a coupling portion. The two coupling projections 1*g* are symmetric with each other about the center of the wiring base 1 as viewed in traverse cross section, and the two coupling recesses 1*h* are also symmetric with each other about the center, whereby two or more wiring bases 1 can be coupled properly irrespective of their orientation. For the same reason, respective portions of each wiring base 1 are formed to be symmetric with one another about the center of the wiring base in traverse cross section, as understood from the foregoing explanation.

In the following, a manufacturing and assembling method for the electrical connection box will be explained.

Figure 9:
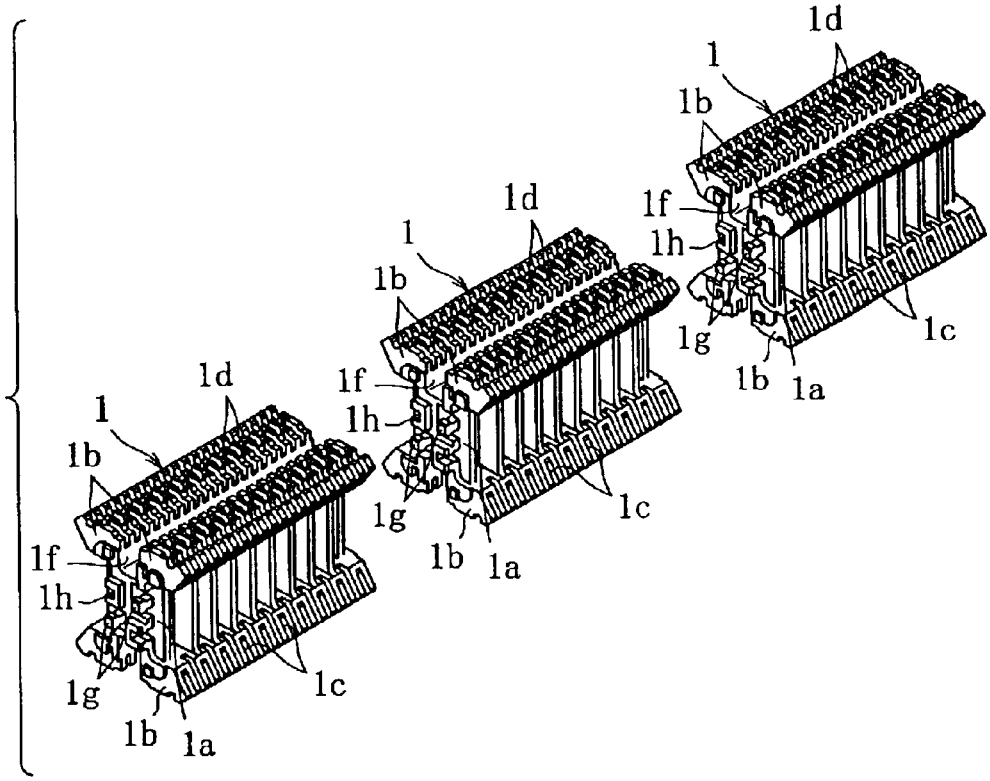
FIG. 9 is a perspective view showing three wiring bases of FIG. 1 in a state where they are about to be coupled to one another.

In this embodiment, e.g., three wiring bases 1 are coupled for use as shown in FIG. 9. To this end, the coupling projections 1*g* and coupling recesses 1*h* formed on one end face of a first wiring base 1 are respectively fitted to the coupling recesses 1*h* and coupling projections 1*g* formed on one end face of a second wiring base 1, whereby the first wiring base is coupled at one end face to the second wiring base. Similarly, the first wiring base 1 is coupled at its another end face to a third wiring base 1, thereby constituting a wiring base group comprised of three wiring bases 1 coupled to one another.

Next, holders (not shown) are pressed against the opposite end faces of the wiring base group, whereby the wiring base group is retained between the holders. Since the wiring base group can be securely retained by the holders in this manner, instead of the coupling configuration shown in FIGS. 10A and 10B having an uncoupling prevention function, a simple coupling portion exemplarily shown in FIGS. 11A and 11B can be used that consists of a coupling projection 1*i* and a coupling recess 1*j* without an uncoupling prevention function.

Figure 12:
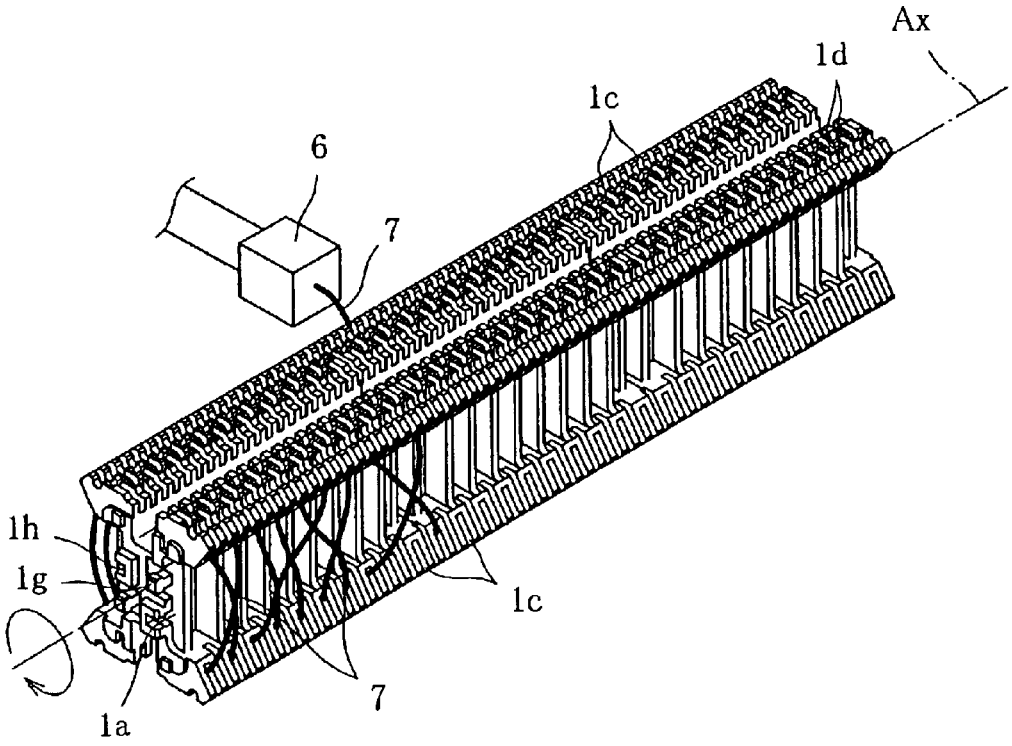
FIG. 12 is a perspective view showing the coupled wiring bases in a state where a wire is being laid thereon.

Then, the wire 7 fed from a wiring head 6 is wound around the wiring base group, while rotating the holders to thereby cause the wiring base group to rotate in unison therewith around the longitudinal axis Ax of the wiring base group as shown by the arrow in FIGS. 12, 13A and 13B, whereby the wire is laid in accordance with a prescribed wiring pattern, with various portions of the wire being received in the desired wire grooves 1*c*.

Figure 10A:
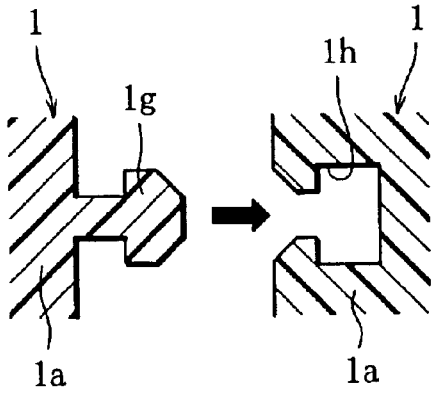
FIG. 10A is a fragmentary sectional view showing exemplified coupling portions of two wiring bases in a state where the wiring bases are about to be coupled to each other.
Figure 10B:
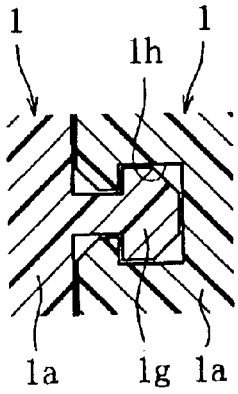
FIG. 10B is a fragmentary sectional view showing the coupling portions of FIG. 10A in a coupled state.
Figure 11A:
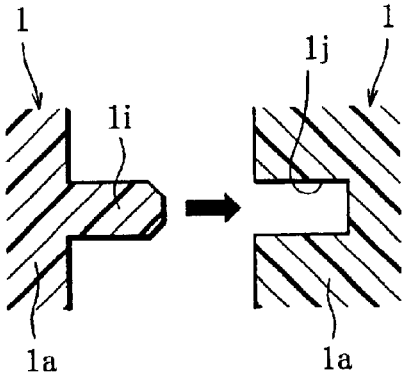
FIG. 11A is a view, similar to FIG. 4A, showing another example of coupling portions.
Figure 11B:
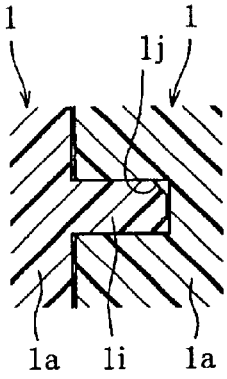
FIG. 11B is a fragmentary sectional view showing the coupling portion of FIG. 11A in a coupled state.

During the wiring operation, the three wiring bases 1 coupled to one another to constitute the wiring base group are substantially immovable in the direction of the longitudinal axis Ax since the wiring base group is pressed at its opposite end faces against the holders. Also, the coupled wiring bases 1 are substantially immovable in the direction perpendicular to the longitudinal axis Ax since their coupling projections 1*g* and coupling recesses 1*h* are fitted to one another as shown in FIGS. 10A and 10B. Therefore, the wiring operation for the wiring base group comprised of the coupled wiring bases 1 can be carried out smoothly and rapidly as in the case where the wiring base group is comprised of a single wiring base, whereby a wired assembly comprised of the wiring base group and the wire wound thereon can be efficiently manufactured. The wired assembly can be made compact by constituting the wiring base group by means of an appropriate number (one or more) of wiring bases.

During the wiring operation, the wiring base group comprised of the three coupled wiring bases 1 is rotated around its longitudinal axis as shown by the arrow in FIGS. 13A and 13B, and reaches the rotating position shown in FIG. 13B in which the wiring base group interferes with the wiring head 6. Although the interference between the wiring base group and the wiring head 6 can be avoided by moving the wiring head 6 in the direction away from the wiring base group before such a rotation position is reached, the wiring head 6 of this embodiment is arranged to be rotatable by the rotating wiring base group interfering therewith and returnable to a normal position by means of, e.g., a spring force when the interference with the wiring base group disappears, thus permitting further rotation of the wiring base group to continue the wiring operation. Each wiring base 1 is provided with guide ribs 1*e* that are formed integrally with the wing portions 1*b* so as to project circumferentially therefrom and that define therebetween wire guide grooves 1*ec* respectively communicating with the wire grooves 1*c* of the wing portions 1*b*.

With the aforementioned arrangement, on the occasion that corresponding ones of the guide ribs 1*e* of the wiring base group interfere at their outer faces 1*ea* with the wiring head 6, the wiring base group further rotates in the direction shown by the arrow while rotating the wiring head 6, and the wire 7 fed from the wiring head is received in a wire guide groove 1*ec* between the guide ribs 1*e* concerned and then received in a desired wire groove 1*c* communicating with the wire guide groove. At this time, since the outer faces 1*ea* of the guide ribs 1*e* extend obliquely relative to the wing portions 1*b*, an angle of rotation of the wiring head 6 from when the outer faces 1*ea* of the guide ribs 1*e* interfere with the wiring head 6 to when the wire 7 is received in the desired wire groove 1*c* through the wire guide groove 1*ec* is suppressed to be small, whereby the increase in the distance between a wire feed port 6*b* of the wiring head 6 and the wire groove 1*c* is suppressed. The guide rib face 1*ea* is immediately brought in face-contact with the wiring head 6.

As a result, even at a higher wiring speed, a deviation of the wiring head 6 in the longitudinal direction of the wiring base group is suppressed to prevent the wire 7 fed from the wiring head 6 from being dislocated from the wire groove 1*c*. Therefore, the wire 7 can be laid in the desired wiring pattern by moving the wiring head 6 along the longitudinal axis Ax, with the wire head movement being intermittently decelerated or stopped if necessary, without the need of moving the wiring head in the directions away from and towards the wiring base group. This permits the wire to be laid on the wiring base group with accuracy in a short time, achieving inexpensive fabrication of the wired assembly having the wiring base group wound with the wire.

Figure 8:
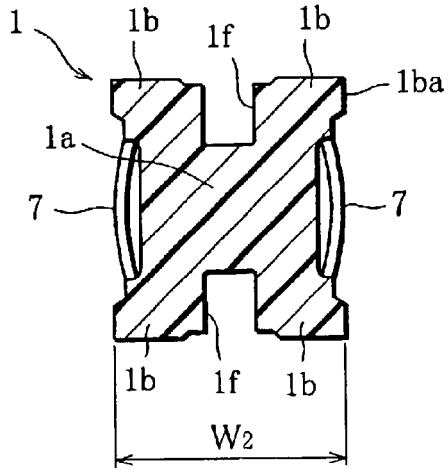
FIG. 8 is a sectional view showing the wiring base in a state that the guide ribs are removed therefrom.

As shown in FIG. 6, the wiring base 1 provided at wing portions 1*b* with guide ribs 1*e* has a large width W1, however, these guide ribs 1*e* can be removed from the wing portions 1*b* after completion of the wiring. By removing the guide ribs 1*e*, the wiring base 1 has a smaller width W2 (<W1) as shown in FIG. 8.

Figure 7:
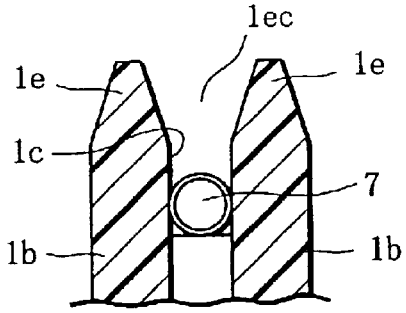
FIG. 7 is a fragmentary enlarged sectional view showing guide ribs provided in the wiring base.
Figure 14:
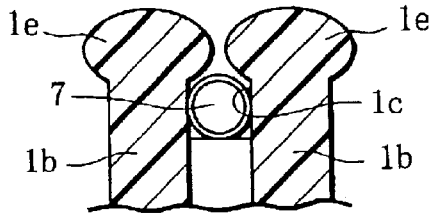
FIG. 14 is a fragmentary view showing the guide ribs in a state where their distal ends are crushed.
Figure 15A:
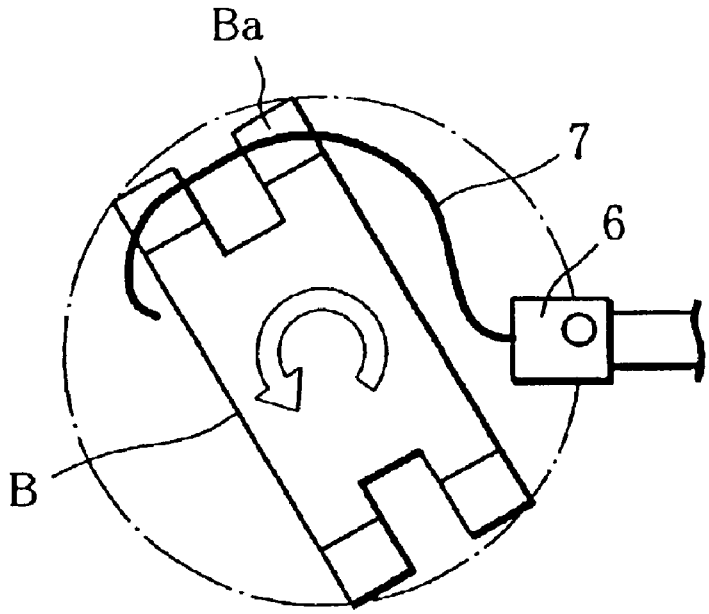
FIG. 15A is a schematic view showing an operation of laying a wire on a conventional wiring base in a state where the wiring base does not interfere with a wiring head.
Figure 15B:
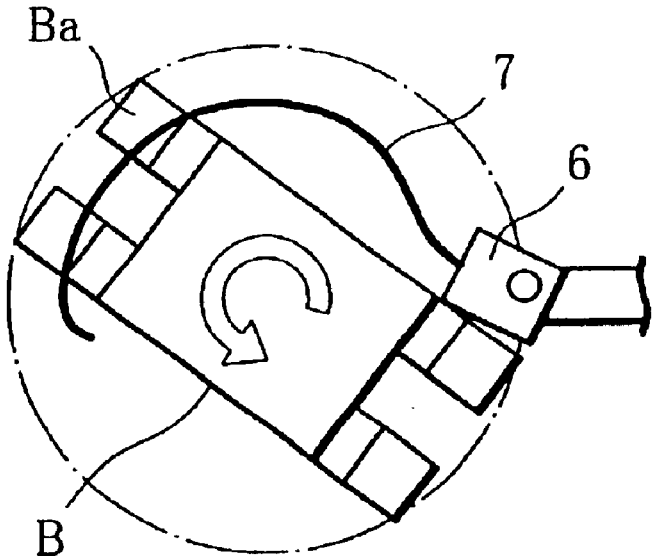
FIG. 15B is a schematic view showing the wire-laying operation in a state where the wiring base interferes with the wiring head.

Since the guide rib 1*e* thins toward radially outward as shown in FIG. 7, the laid wire 7 may be disengaged from the wire groove 1*c* during the handling of the wired assembly. To prevent the wire 7 from being disengaged from the wire groove 1*c*, it is preferable to heat distal ends of the guide rib 1*e* to be melt and crushed as shown in FIG. 14.

After obtaining the wired assembly having the wiring base group wound with the wire 7, the wire is cut off at desired portions in accordance with the prescribed wiring pattern, with use of a cutter (not shown) that can be placed in upper and lower cutter grooves 1*f* formed in the wiring base group.

Next, reinforcing plates 8 are mounted to the upper and lower cutter grooves 1*f* of the wiring base group, and connecting terminals such as solderless terminals 4 and joint terminals 5 (see FIG. 1) are press-fitted into desired terminal grooves 1*d*, respectively, causing each connecting terminal to be wedged into an insulation of the wire 7 and electrically connected to a conductor of the wire 7.

Subsequently, the wired assembly is accommodated in a casing 11 that is comprised of upper and lower casings 12, 13 having engaging portions 12*c*, 13*c* through which they are engaged with each other. Next, connectors, not shown, are mounted to the solderless terminals 4 that are individually accommodated in connector housings 12*b* formed in an upper portion of a main body 12*a* of the upper casing 12. Each terminal 4 is formed into a crank shape and can buckle when mounted with a connector. In mounting the connector to the terminal 4, however, the terminal 4 is supported by a reinforcing plate 8 to be prevented from buckling. In the above manner, the electrical connection box 10 shown in FIGS. 1 and 2 is fabricated.

The wiring base and electrical connection box of this invention are not limited to the foregoing embodiment, and may be modified variously.

For instance, the wiring base group may be constituted by an appropriate number (one or more) of wiring bases although a case where the wiring base group consists of the three coupled wiring bases has been explained in the embodiment. For the wiring base group consisting of a single wiring base, it is unnecessary to provide the wiring base with a coupling portion.

It is not inevitably necessary to provide wing portions of the wiring base with guide ribs serving as a guide portion or to constitute the wiring head to be rotatable relative to a head support and returnable to a normal position. Alternatively, during the wiring, the wiring head may be moved in the direction away from the rotating wiring base before occurrence of interferences therewith, and then moved in the direction towards the wiring base.

It is not essential to provide the wiring base with a reinforcing plate.

The electrical connection box may be provided with one or more fuse housings each mounted with a fuse, together with or instead of connector housings.

In other respects, the present invention may be modified variously without departing from the scope of the invention.

What is claimed is:

1. A wiring base molded from an electrical insulating material comprising:

a base body extending along a longitudinal axis of the wiring base;

wing portions formed on an outer periphery of said base body so as to be circumferentially spaced apart from one another; and coupling portions individually formed in opposite end faces of said base body to which another wiring base of the same construction extending along said longitudinal axis can be coupled, each of said end faces being adapted to face such other wiring bases, wherein each of said wing portions is formed with wire grooves individually opening to an outer face of the wing portion.

2. The wiring base according to claim 1, wherein each of the wire grooves formed in said each wing portion is aligned with corresponding wire grooves individually formed in other wing portions, as viewed in a direction of the longitudinal axis of the wiring base, and these aligned wire grooves are symmetric with one another about a center of the wiring base as viewed in traverse cross section of the wiring base.

3. The wiring base according to claim 1, wherein said wing portions are formed with terminal grooves that are individually in communication with desired ones of said wire grooves, and each of said terminal grooves extends along the longitudinal axis of the wiring base across a corresponding one of the wire grooves, and is arranged to be inserted with a connecting terminal.

4. The wiring base according to claim 3, further comprising:

a reinforcing plate mounted to a mounting groove that is defined between adjacent ones of said wing portions and that extends along the longitudinal axis of said wiring base, said reinforcing plate serving to support connecting terminals individually inserted into corresponding ones of the terminal grooves.

5. The wiring base according to claim 1 or 4, further comprising:

guide portions respectively formed integrally with said wing portions so as to project circumferentially from said wing portions, said guide portions being formed with wire guide grooves that open to an outer face of the guide portion and being in communication with the wire grooves, respectively, each of the guide portions having a flat outer face thereof extending at an acute angle relative to a boundary face between the guide portion and a corresponding one of said wing portions.

6. A wiring base molded from an electrical insulating material, comprising:

a base body extending along a longitudinal axis of the wiring base;

wing portions formed on an outer periphery of said base body so as to be circumferentially spaced apart from one another, each of said wing portions being formed with wire grooves individually opening to an outer face of the wing portion, each of said wire grooves formed in said each wing portion being aligned with corresponding wire grooves individually formed in other wing portions as viewed in a direction of the longitudinal axis of the wiring base, these aligned wire grooves being symmetric with one another about a center of said wiring base as viewed in traverse cross section of said wiring base, said wing portions being formed with terminal grooves that are in communication with desired ones of said wire grooves, each of the terminal grooves extending across a corresponding one of the wire grooves in the direction of the longitudinal axis of the wiring base and being arranged to be inserted with a connecting terminal; and a reinforcing plate mounted to a mounting groove that is defined between adjacent ones of said wing portions and that extends along the longitudinal axis of said wiring base, said reinforcing plate serving to support connecting terminals individually inserted into corresponding ones of the terminal grooves.

7. A wiring base molded from an electrical insulating material, comprising:

a base body extending along a longitudinal axis of the wiring base;

wing portions formed on an outer periphery of said base body so as to be circumferentially spaced apart from one another, each of the wing portions being formed with wire grooves individually opening to an outer face of the wing portion, each of the wire grooves formed in each of said wing portions being aligned with corresponding wire grooves individually formed in other wing portions as viewed in a direction of the longitudinal axis of the wiring base, these aligned wire grooves being symmetric with one another about a center of said wiring base as viewed in traverse cross section of said wiring base; and guide portions respectively formed integrally with said wing portions so as to project circumferentially from said wing portions, said guide portions being each formed with wire guide grooves that open to an outer face of the guide portion and being in communication with said wire grooves, respectively, each of said guide portions having a flat outer face thereof extending at an acute angle relative to a boundary face between the guide portion and a corresponding one of said wing portions.

8. The wiring base according to claim 7, wherein said each guide portion is provided with ribs defining the wire guide grooves therebetween, and each of the ribs thins towards outward.

9. The wiring base according to claim 8, wherein said each rib thins at a boundary with a corresponding wing portion.

10. An electrical connection box comprising:

a wire base group comprised of one or more wiring bases as set forth in claim 1, 6 or 7;

a wire laid on said wire base group and cooperating with said wire base group to form a wired assembly; and a casing for accommodating therein said wired assembly.

* * * * *